United States Patent [19]

Reinert et al.

[11] 4,380,961

[45] Apr. 26, 1983

[54] VARIABLY CONTROLLABLE BOBBIN THREAD PULL-OFF MECHANISM

[75] Inventors: Gerhard Reinert, Bayside, N.Y.; Donald R. Davidson, Berkeley Heights, N.J.

[73] Assignee: The Singer Company, Stamford, Conn.

[21] Appl. No.: 246,564

[22] Filed: Mar. 23, 1981

[51] Int. Cl.[3] ..... D05B 57/14; D05B 57/26

[52] U.S. Cl. ..... 112/231

[58] Field of Search ..... 112/181, 182, 184, 186, 112/183, 228, 229, 231, 233, 279, 191

[56] References Cited

U.S. PATENT DOCUMENTS

| | | | |
|---|---|---|---|
| 3,155,061 | 11/1964 | Goebel et al. | 112/228 X |
| 3,164,113 | 1/1965 | Ketterer | 112/242 |
| 3,693,565 | 9/1972 | Ketterer | 112/184 |
| 3,693,566 | 9/1972 | Ketterer | 112/184 |
| 4,091,753 | 5/1978 | Johnson et al. | 112/184 |
| 4,182,250 | 1/1980 | Johnson | 112/184 |
| 4,215,639 | 8/1980 | Johnson | 112/242 |
| 4,232,618 | 11/1980 | Ketterer | 112/184 |

FOREIGN PATENT DOCUMENTS 53-79647 7/1978 Japan .

*Primary Examiner*—Wm. Carter Reynolds

*Attorney, Agent, or Firm*—William V. Ebs; Robert E. Smith; Edward L. Bell

[57] ABSTRACT

A variable pull-off mechanism for a sewing machine is provided with a thread pull-off disc on a rotatably mounted shaft which is concentric with the drive shaft of a vertical axis looptaker. The disc is formed with thread catching edges which engage and pull-off thread from a bobbin as the disc is oscillated between a fixed and a controllable position in accordance with the operation of a servomotor responsive to various control signals.

9 Claims, 11 Drawing Figures

58
66
60
62
34
59
70
56
64
74
32
130
132
126
124
122
146
30
148
150
174
36
206
208
160
162
156
152
153
154
176
166
182
170
168
172
188
186
184
72
212
210
75
90
88
204
200
202
198
136
134
138
143
140
98
142
144
94
116
128
96
118
112
120
110
192
108
102
114
104
86
78
84
80
106
92
76
82
100

Fig. 8.
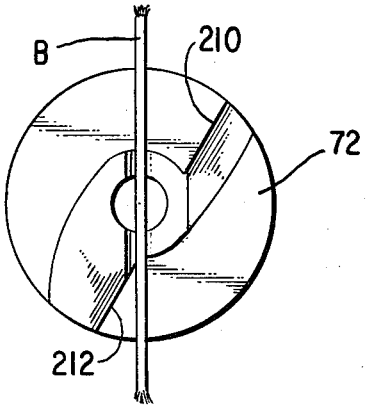
Fig. 9.
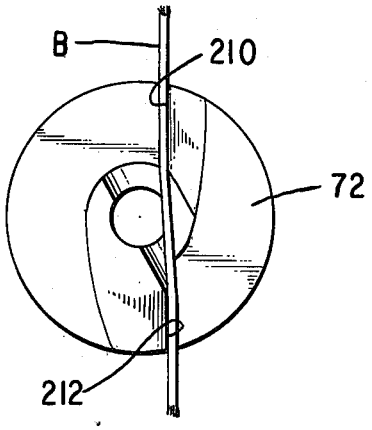
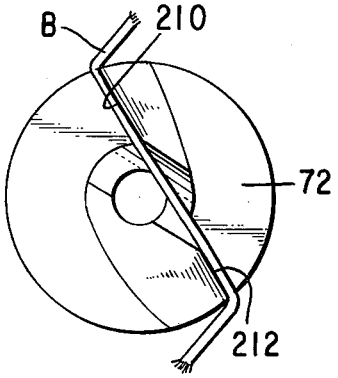
Fig. 10.
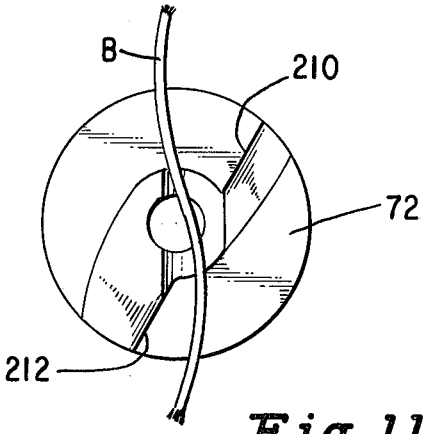
Fig. 11.

VARIABLY CONTROLLABLE BOBBIN THREAD PULL-OFF MECHANISM

DESCRIPTION

BACKGROUND OF THE INVENTION

1. Field of the Invention

The invention relates to underbed thread pull-off mechanisms for use in lockstitch sewing machines, and more particularly to bobbin thread pull-off mechanisms for such use which can be variably controlled to provide for the withdrawal of suitable amounts of thread from the bobbin of a lockstitch sewing machine depending upon the particular sewing operation to be performed.

2. Description of the Prior Art

It is well known to provide a lockstitch machine with means for pulling thread from a bobbin spool for use in the formation of stitches. Most commonly, such means have been adapted to supply a constant amount of thread for each stitch regardless of the length of stitch called for, the type of stitch to be formed, or the thickness of material being sewn. However, variable operable pull-off mechanisms with which the amount of thread withdrawn from a bobbin can be changed to meet a need defined by the type of operation to be performed on a sewing machine have been devised. U.S. Pat. No. 4,215,639 of Ralph E. Johnson for "Selectively Controllable Bobbin Thread Pull-Off Mechanism," issued Aug. 5, 1980, shows such a mechanism controllable as by a servomotor responsive to signals representing a selected stitch length, a presser bar position and needle bight. Abandoned U.S. patent application of Stanley J. Ketterer for "Variable Bobbin Thread Control for Lockstitch Looptaker," Ser. No. 055847, filed July 9, 1979, and assigned to the same assignee as the present application, discloses a shiftable pull-off and retraction element on a looptaker capable of providing an effect similar to the increased or decreased pull-off of bobbin thread. U.S. Pat. No. 4,182,250 of Ralph E. Johnson for "Bobbin Thread Control Means for a Lock Stitch Sewing Machine" issued Jan. 8, 1980, discloses mechanism for pulling thread from a bobbin spool in amounts which can be predetermined by the setting of a stitch length regulator.

Stitches which are neither too tight nor too loose are more readily formed with a variably controllable bobbin thread pull-off mechanism than with a pull-off mechanism which must always supply the same amount of bobbin thread for stitches. However, the known variably controllable bobbin thread pull-off mechanisms, if not structurally complex or somewhat insensitive to input signals, are at least limited in the signals to which they are adapted to respond.

It is a prime object of the present invention to provide an improved variably controllable bobbin thread pull-off mechanism which is lacking in complexity and which can be rendered readily responsive to multiple signals.

It is another object of the invention to provide an improved variably controllable bobbin thread pull-off mechanism as described which can be mounted on a shaft concentric with the rotational axis of a looptaker.

Other objects and advantages of the invention will become apparent during a reading of the specification taken in connection with the accompanying drawings.

SUMMARY OF THE INVENTION

In accordance with the invention, a thread pulling disc is mounted on a shaft which is concentric with the drive shaft of a vertical axis looptaker of a lockstitch sewing machine, and which is operably connected with activating means for oscillating the disc between a fixed and a controllable position. The disc includes a pair of substantially radial edges which are about 180° apart. Such edges catch and pull the bobbin thread during movement of the disc from a fixed to the controllable position, and release the thread after the controllable position has been reached. A bobbin case provided for use in connection with the thread pulling disc is shaped to position the bobbin thread in the path of the disc's thread catching edges. Movements of the thread pulling disc in an assembly including the disc, looptaker and bobbin winding mechanism are selectively controllable.

DESCRIPTION OF THE DRAWINGS

FIGS. 8 through 11 are top plan views indicating oscillatory movements of a bobbin thread pull-off disc according to the invention.

DESCRIPTION OF THE INVENTION

Figure 1:
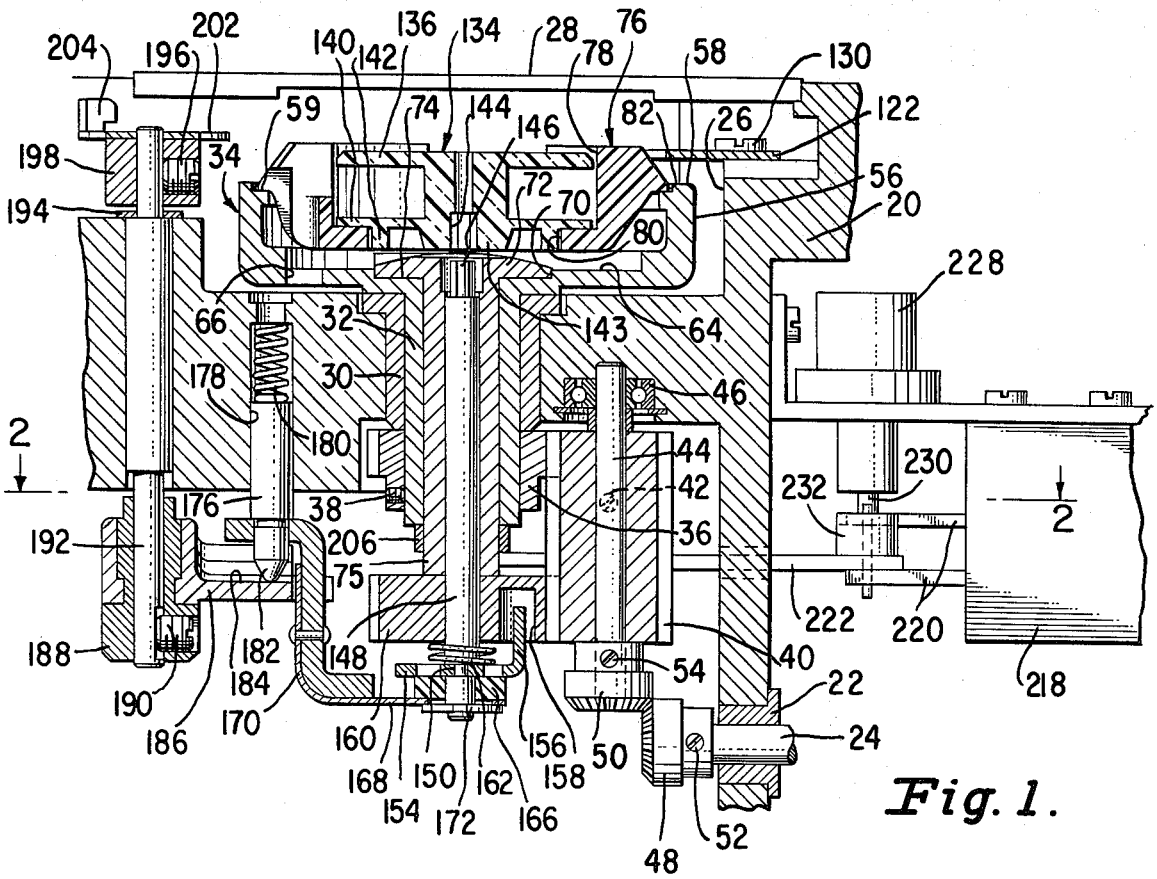
FIG. 1 is a vertical sectional view taken lengthwise along a sewing machine bed through the axis of a rotary looptaker, and showing bobbin thread pull-off mechanism according to the invention.
Figure 2:
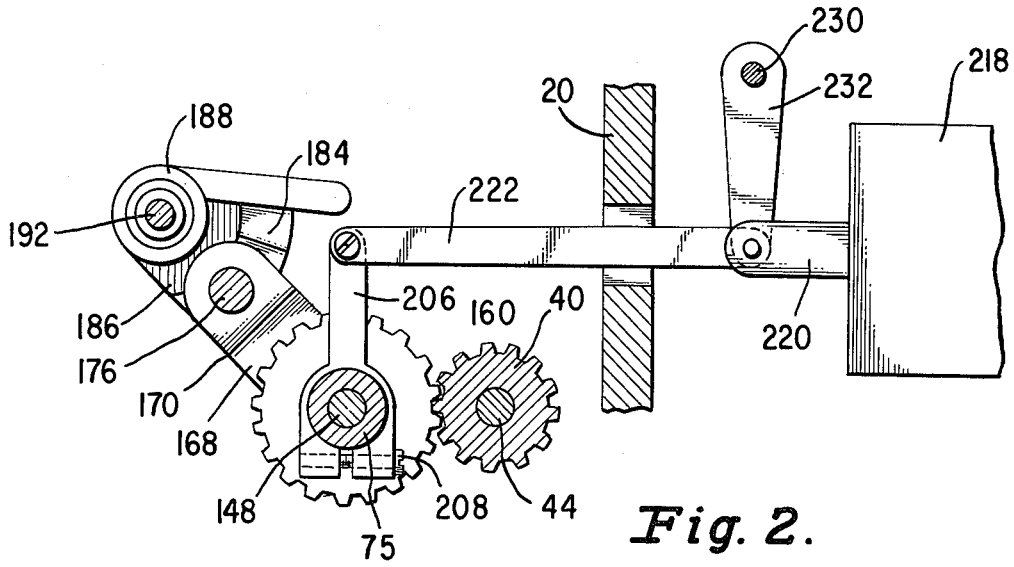
FIG. 2 is a planar view taken substantially on the plane of the line 2—2 of FIG. 1.
Figure 3:
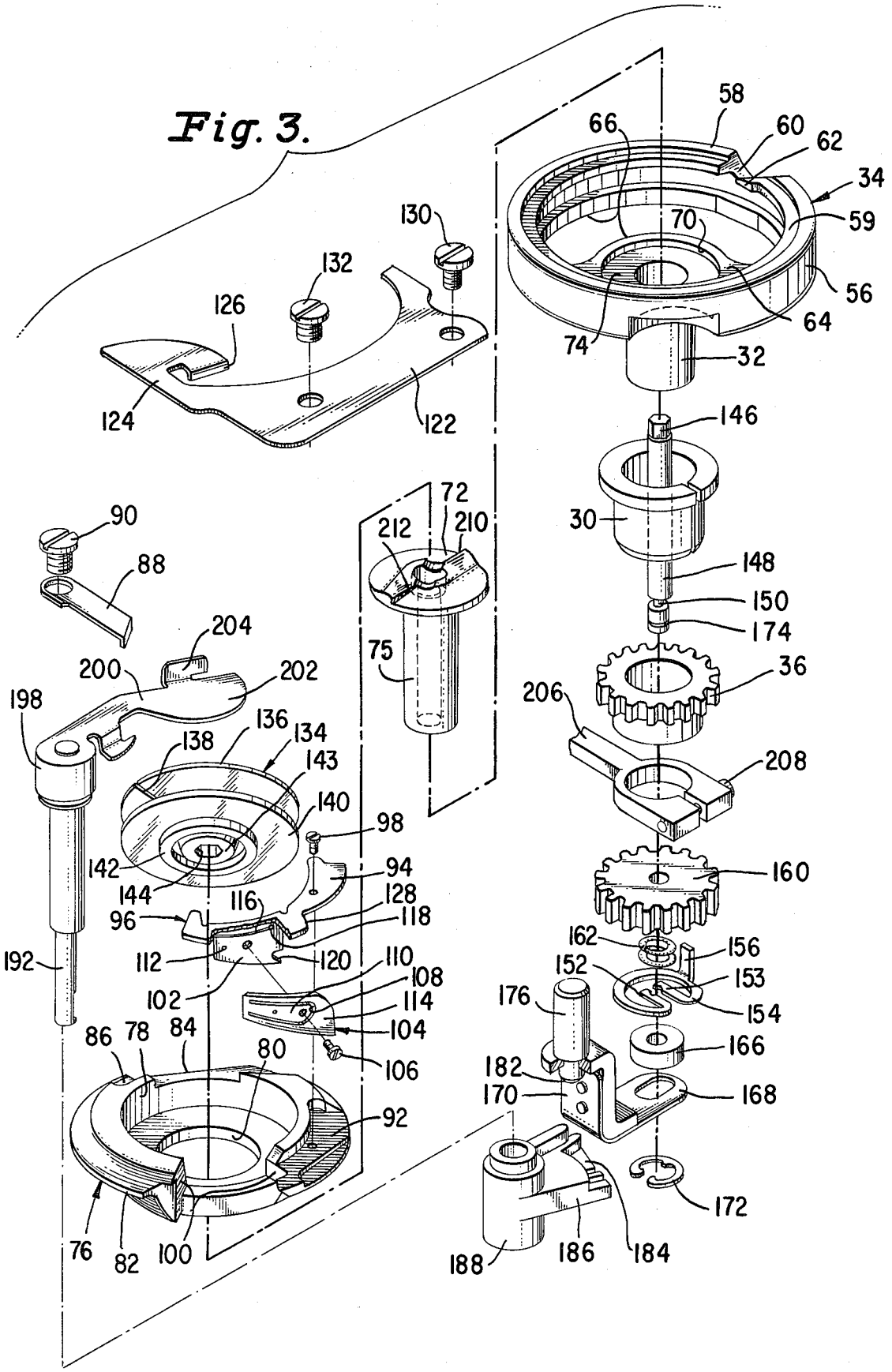
FIG. 3 is a disassembled perspective view of the looptaker and bobbin thread pull-off mechanism of the invention.
Figure 5:
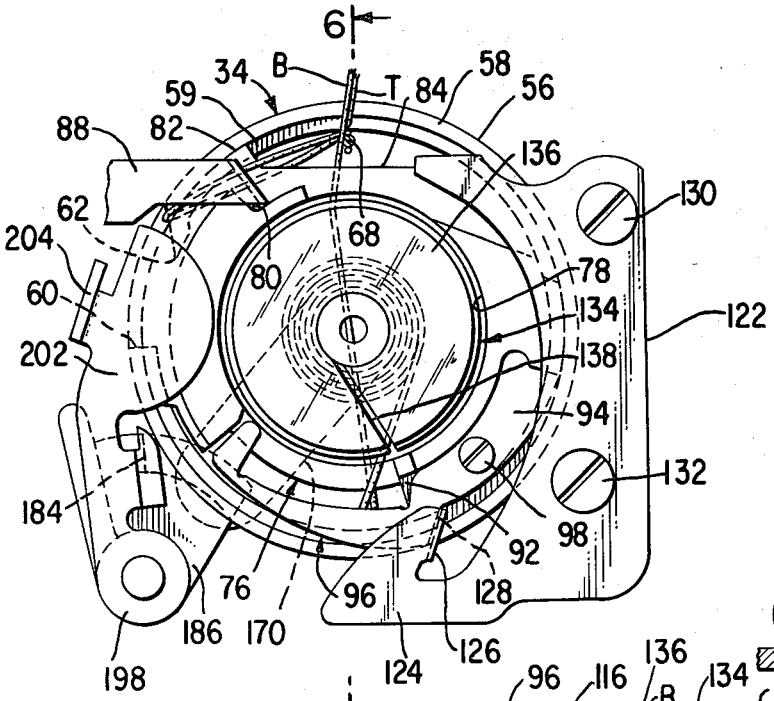
FIG. 5 is a top plan view of the looptaker of FIG. 1 together with mechanism for constraining the bobbin case in place in the looptaker and including the bobbin thread in readiness for sewing.
Figure 6:
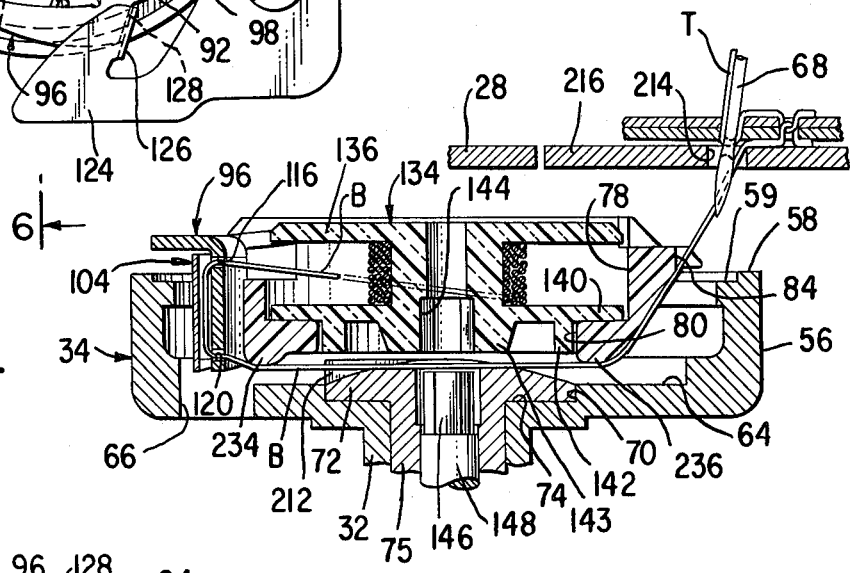
FIG. 6 is an enlarged cross sectional view of the looptaker taken substantially on the plane of the line 6—6 of FIG. 5.
Figure 4:
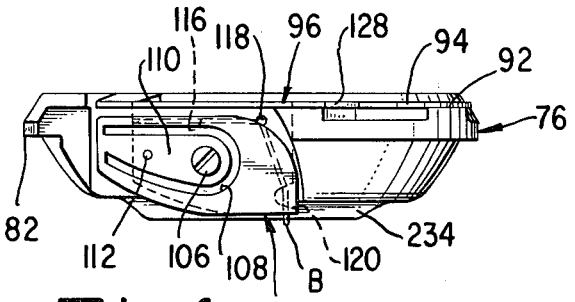
FIG. 4 is an elevational view of a bobbin case illustrating bobbin thread tensioning means with bobbin thread issuing therefrom as during sewing.

Referring to the drawings, reference character 20 designates the bed of a sewing machine frame carrying a bushing 22 in which a bed shaft 24 is journalled. The bed 20 is formed with an upwardly open looptaker accommodating cavity 26 closed by a slide cover plate 28. Rotatable in a bushing 30 carried in the bed is a hollow looptaker shaft 32 which is attached by welding or the like to the underside of a looptaker indicated generally at 34 which is disposed in the cavity 26.

The looptaker is imparted turning movement in one direction during operation of the sewing machine by a gear 36 made fast to the looptaker shaft by a set screw 38. Gear 36 meshes with and is driven by a gear 40 affixed by a screw 42 to a shaft 44 which is rotatably mounted in a bearing 46 in bed 20. Shaft 44 is driven by the bed shaft 24 through meshing bevel gears 48 and 50 affixed to the shafts 24 and 44 respectively by set screws 52 and 54.

As shown, the looptaker 34 has an upwardly open cup shaped form including a rim 56 with a top edge 58. The rim is formed with an annular inwardly extending bearing rib 59 having a lateral opening 60 formed at one side with a needle thread loop seizing beak 62. The looptaker includes a base 64 with an annular opening 66 providing clearance for the tip of a needle 68. The looptaker further includes a central recess 70 wherein a bobbin thread pull-off disc 72 in accordance with the invention is supported on a shoulder 74. As shown, the pull-off disc is integral with a hollow shaft 75 which is concentric with and extends within hollow looptaker shaft 32.

Constrained within the cup-shaped rotary looptaker over the pull-off disc 72 is a bobbin case indicated generally at 76. The bobbin case is formed with an upwardly open bobbin accommodating cavity 78 through the bottom of which a large control aperture 80 extends. Externally, the bobbin case includes a bearing flange 82 which is slabbed as at 84 substantially along a chord to provide clearance for the path of needle reciprocation between the bobbin case and looptaker. Adjacent to the slabbed portion 84, the bobbin case flange 82 is formed with a shallow recess 86 which receives a rotation restraining element 88 secured by a screw 90 to the machine bed 20. The bobbin case flange 82 is formed substantially opposite slabbed portion 84 with a recess 92 on which a support arm 94 of a bobbin thread tensioning spring bracket 96 is secured by a fastening screw 98.

The bobbin case 76 adjacent to the recess 92 in the flange 82 is formed with a radial opening 100 across which the thread tensioning spring bracket 96 spans. A downturned arm 102 on the bracket 92 is disposed in the bobbin case radial opening 100 and provides a mounting surface against which a bobbin thread tensioning spring 104 is secured by a screw 106. As shown the spring 104 is formed with a slot 108 in the form of a U-shaped loop separating a tongue 110 through which the securing screw 106 and a locating pin 112 on the bracket arm 102 pass. Surrounding the tongue 110 is an outer spring blade portion 114 which frictionally engages the bobbin thread against the downturned bracket arm 102 to provide the bobbin thread tension. The downturned arm 102 is formed with a thread entry slot 116 which terminates in an eyelet 118 for directing the thread to the blade portion 114 of the spring 104. Below the spring, the downturned arm 102 is formed with a thread guiding groove 120 from which the bobbin thread leaves the spring and proceeds to a stitching point. The tension exerted on the thread by the spring blade portion 114 may be adjusted by regulating the fastening screw 106.

For restraint of the bobbin case within the looptaker, there is provided (in addition to element 88), a base plate 122 with a holddown arm 124 having a downturned restraining lip 126 thereon to abut a shouldered portion 128 of the support arm 94 of thread tensioning spring bracket 96. As shown, such base plate 122 is secured to the bed 20 with screws 130 and 132.

Within the bobbin accommodating cavity 78 of the bobbin case is a bobbin indicated generally at 134. The bobbin is normally freely rotatable within the bobbin case. Such bobbin includes a top flange 136 formed with an outwardly extending slot 138 skewed slightly from a true radial position on the top flange. The bobbin also includes a bottom flange 140 having a depending rim 142 which fits into central aperture 80 of the bobbin case 76, and having a depending boss 143 which is formed with a central hexagonal aperture 144 to match the hexagonal extremity 146 of a spindle 148 concentric with and extending within a hollow shaft 75. The spindle is normally disconnected from the bobbin but is associated with bobbin thread replenishing mechanism of the kind disclosed in U.S. Pat. No. 3,693,566 of Stanley J. Ketterer for "Bobbin Thread Replenishing Mechanism for Sewing Machines" issued Sept. 26, 1972 by means of which the spindle can be raised to cause the spindle extremity 146 to enter aperture 144 and the spindle to drive the bobbin.

As shown, the spindle 148 near its lower extremity is formed with an annular groove 150 in which the opposed spring arms 152 and 153 of a friction washer 154 is snapped. The friction washer includes an upturned finger 156 which is accommodated in a notch 158 formed on the underside of a gear 160 on the spindle shaft. Gear 160 is biased upwardly on the spindle by a spring 162 located between the gear and washer 154, and is thereby held in a position wherein the gear is against the bottom end of shaft 75 and is engaged by gear 40 which also engages gear 36 on looptaker shaft 32. Spindle 148 is driven with the looptaker during operation of the machine by way of the friction coupling between the friction washer 154 and the spindle. Should sufficient resistance to the turning of the spindle 148 arise, the spindle may turn fully relative to the washer 154. A driving relationship is reestablished only when the resistance to turning drops below the torque necessary to cause the friction washer to slip on the spindle 148.

Beneath the friction washer 154 on the spindle 148 is positioned a plain washer 166 and the lateral arm 168 of an angle bracket 170. A spring clip 172 seated in an annular notch 174 in the spindle 148 maintains the parts on the spindle. The angle bracket 170 has fastened thereto an upstanding cylindrical guide stud 176 which slides in a guide base 178 formed in the bed 20. A coil spring 180 confined in the guide bore 178 bears against the guide stud 176 and biases the bracket 170 and spindle 148 downwardly.

The guide stud 176 extends through the angle bracket 170 and is formed beneath the angle bracket with a tapered cam follower head 182. The cam follower head 182 tracks a cam surface 184 formed on a radial arm 186 which projects from a hub 188 secured as by a set screw 190 on the lower extremity of a fulcrum stud 192 journalled in the machine bed 20. The fulcrum stud 192 is retained in the machine bed by a spring clip 194, and above the machine bed has fastened thereon by a set screw 196 the hub portion 198 of a control arm 200. The control arm 200 is formed with a blade 202 which is movable over the looptaker. A finger grip 204 is formed to extend upwardly from the blade 202 and serves for manual positioning of the control arm 200. When the control arm is shifted in a clockwise direction the cam surface 184 acting upon the cam follower head 182 elevates the spindle to cause the hexagonal end 146 thereof to at least partially extend above thread pull-off disc and enter into a driving relationship with the bobbin 134 in hexagonal aperture 144. The manner in which thread is wound on a rotating bobbin is fully explained in the aforementioned U.S. Pat. No. 3,693,566 and is therefor not repeated here.

As indicated hereinbefore, the thread pull-off disc 72 is integral with a shaft 75 which is mounted within hollow looptaker shaft 32. A link 206 for imparting reciprocatory turning movements to the shaft 75 and thereby to the pull-off disc is affixed by a set screw 208 to the lower end of this shaft. The pull-off disc 72 is formed with raised edges 210 and 212 which extend substantially radially on its top surface and face in opposite directions. Such raised edges 210 and 212 on the pull-off disc serve during sewing operations in the machine to pull thread from the bobbin for use in the formation of stitches.

During sewing operations thread B from the bobbin extends between the thread tensioning spring bracket 96 and bobbin case, into the thread guide slot 116 to eyelet 118, and between the bracket arm 102 and thread tensioning spring blade portion 114 to the groove 120. The bobbin thread further extends from the groove 120 beneath the bobbin case, traverses the base 64 of the looptaker and passes through needle aperture 214 in throat plate 216. As the looptaker rotates, a loop of needle thread T is seized by the looptaker beak 62 and passed completely around the bobbin to encompass the bobbin thread which is drawn upwardly through the aperture 214 to provide for the formation of lockstitches all as fully described in U.S. Pat. No. 3,693,565 of Stanley J. Ketterer for "Lockstitch Loop Takers for Sewing Machines" issued Sept. 26, 1972.

The pull-off disc 72 is oscillated during sewing operations through a controlled angle as by a reversible linear servomotor 218 having its output shaft 220 operably connected to shaft 75 through an intermediate link 222, and the link 206. Servomotor 218 may be of the kind shown, for example, in U.S. Pat. No. 3,984,745. As such, the servomotor may be operated to oscillate disc 72 between a fixed position (FIG. 8 position) and a variably controllable position (FIG. 10 position) by conventional seromotor control circuitry responsive to a pulse signal for each rotation of an arm shaft of the sewing machine, and responsive to control signals representing, for example, a selected stitch length, a presser bar position, and needle bight. Reference character 228 designates a rotary potentiometer for providing a position feed back signal in such circuitry. As shown, the potentiometer shaft 230 is connected by way of a link 232 with the servomotor output shaft 220.

Figure 7:
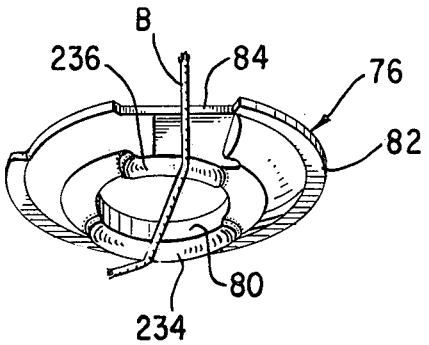
FIG. 7 is a bottom perspective view of the bobbin case.

Counterclockwise movement of the disc 72 from its fixed FIG. 8 position causes the raised edges 210 and 212 of the disc to engage the bobbin thread B (see FIG. 9), engagement of the edges 210 and 212 with the bobbin thread being assured by depending formations 234 and 236 (FIG. 7) on the bottom of the bobbin case for disposing the thread in the path of the raised edges.

Continued turning of the disc 72 in the counterclockwise direction results in bobbin thread B being pulled from the bobbin in the amount dependent upon the position attained by the disc (FIG. 10) as determined by control signals representing, for example, stitch length, presser bar position and needle bight. The disc moves away from its FIG. 10 position in a clockwise direction and returns to the fixed position of FIG. 8 leaving slack bobbin thread (FIG. 11) for use in the formation of stitches.

With the angular oscillatory movements of the pull-off disc timed by the pulse signals indicating complete rotational movements of the arm shaft of the machine so as to cause bobbin thread to be pulled from the bobbin between loop seizures of the needle thread T by beak 62, and with the quantity of thread being supplied in accordance with factors such as stitch length, presser bar position and needle bight, perfect stitches may be sewn regardless of the length of stitch to be sewn, the thickness of the material being stitched and whether or not straight or zig-zag stitches are called for.

It is to be understood that the present disclosure relates to a preferred embodiment of the invention which is for purposes of illustration only, and that various modifications may be made therein without departing from the spirit and scope of the invention as defined in the appended claims.

We claim:

1. In a sewing machine, a vertical axis looptaker including a drive shaft therefor, a non-rotatable bobbin case in the looptaker, a disc housed within the looptaker, a drive shaft for the disc concentric with the drive shaft for the looptaker, a thread carrying bobbin supported on the bobbin case for free rotation above the disc, means operably connected with the looptaker shaft for rotating the looptaker, means operably connected with the disc shaft and responsive to control input signals for causing the disc to be oscillated, between a fixed and a variably controllable position through an angle dependent upon the said signals, the disc being adapted to engage and pull thread from the bobbin according to said angle when the disc is moved in one direction, and to release the thread for use in the formation of a stitch when the disc is moved in the opposite direction.

2. The combination of claim 1 wherein the means operably connected with the disc shaft for causing oscillatory motion to be imparted to the disc includes a linear motor responsive to the said control signals.

3. The combination of claim 1 wherein the disc includes substantially radial edges for engaging and pulling thread from the bobbin.

4. The combination of claim 3 wherein said edges are substantially 180° apart.

5. The combination of claim 1 including a bobbin rewinding shaft operably connectable with the bobbin, such bobbin rewinding shaft being concentric with the disc and looptaker shafts.

6. The combination of claim 5 wherein the means for driving the looptaker shaft includes a gear on the looptaker shaft and a driving gear in engagement with the gear on the looptaker shaft, and wherein the bobbin rewinding shaft is rotatable by a gear on such shaft in engagement with the said driving gear.

7. The combination of claim 6 wherein the means operably connected with the disc shaft includes a shaft actuating member which connects with the disc shaft between the gears on the looptaker shaft and bobbin winding shaft.

8. The combination of claim 1 wherein the bobbin case is shaped to position bobbin thread for engagement by the disc.

9. The combination of claim 1 including depending formations on the bottom of the bobbin case for positioning bobbin thread for engagement by the disc.

* * * * *